US005186029A

United States Patent [19]

Myers

[11] Patent Number: 5,186,029

[45] Date of Patent: Feb. 16, 1993

[54] PADLOCK

[75] Inventor: Gary L. Myers, River Grove, Ill.

[73] Assignee: Fort Lock Corporation, River Grove, Ill.

[21] Appl. No.: 766,122

[22] Filed: Sep. 27, 1991

[51] Int. Cl.[5] ..... E05B 67/22

[52] U.S. Cl. ..... 70/38 A; 70/371

[58] Field of Search ..... 70/35, 38–48, 70/367–371

[56] References Cited

U.S. PATENT DOCUMENTS

| | | | |
|---|---|---|---|
| 2,199,336 | 4/1940 | Fletcher | 70/38 A |
| 2,408,137 | 9/1946 | Gray et al. | 70/38 A |
| 2,433,114 | 12/1947 | Gray | 70/38 A X |
| 2,457,650 | 12/1948 | Dyson | 70/38 A |
| 2,460,615 | 2/1949 | Andrew | 70/38 A X |
| 2,552,028 | 6/1951 | Deutsch | 70/38 A X |
| 3,008,318 | 11/1961 | Gutman | 70/38 A |
| 4,138,868 | 2/1979 | Richards, Sr. | 70/38 A |
| 4,938,039 | 7/1990 | Tzung-I | 70/38 A |
| 4,998,422 | 3/1991 | Borgmann et al. | 70/38 A |

*Primary Examiner*—Renee S. Luebke
*Assistant Examiner*—Suzanne L. Dino
*Attorney, Agent, or Firm*—Leydig, Voit & Mayer

[57] ABSTRACT

An easily assembled padlock with relatively few parts which include an outer casing, an insert shell having a pedestal with a lock plug bore for insertion into the casing, a U-shaped shackle, a lock bolt means actuated by a spring means and having an "assembly" position, a "locked" position and an "unlocked" position, a key operated lock plug for engaging and moving the lock bolt means in the insertable shell bore and a mutual engageable detent means for limiting movement of the lock plug and lock bolt means within the shell bore to only the locked or unlocked positions after assembly. Assembly of the padlock is relatively easy as the components are designed to fit together and be held in place with minimal assembly operations.

8 Claims, 6 Drawing Sheets

PADLOCK

BACKGROUND OF THE INVENTION

1. Field of the Invention

The present invention relates generally to padlocks, and, more particularly, relates to an improved type of construction for padlocks that has very few parts and is easily assembled, thus resulting in lower cost. The preliminary form of such a padlock was disclosed in Disclosure Document No. 255756, filed in the U.S. Patent and Trademark Office on Jun. 18, 1990.

2. Description of the Prior Art

Various types of padlock constructions are well-known in the art. These constructions often have many assembly steps thus adding to the cost. For example, a lock plug is not usually simply inserted into the casing and held in place. Rather, a further assembly step is required to somehow secure the lock plug, as by driving a securing pin through the casing. Such securing steps often generate further assembly steps, such as grinding of the exposed edges of the securing pin. Multiple assembly steps are not limited to the lock plug, however, as assembly of the padlock is usually a multi-step process of some complexity. As a result, such padlocks have higher costs than a padlock that could be assembled more easily.

Another factor adding to the costs of most padlocks is the need for heavy tooling of the component parts. When a solid casing is used, the shackle opening and lock plug openings have to be drilled out. If steel is used, such drilling must be done before hardening, and the drilled body thereafter heat-treated to add security. Further, steel must be plated to prevent corrosion. Casings made of laminates can require even more tooling, as the individual strips must be tooled before they are joined. As mentioned above, tooling can also be required as a post-assembly step as in smoothing the surface of the lock after insertion of a securing pin. Use of such tooling adds time and expense to the making and assembly of a padlock.

It is thus desirable to provide a padlock that is easily and inexpensively assembled, and that does not require a great deal of tooling in its manufacture or assembly.

SUMMARY OF THE INVENTION

It is a primary object of the present invention to overcome the deficiencies of the prior art described above and provide an improved padlock construction which provides the security and features of other padlocks while realizing a significant cost reduction due to the minimizing of parts and ease of construction.

A related object is to provide a padlock construction which does not require significant tooling to allow for the construction.

It is a related object of this invention to provide an improved padlock construction where the component parts simply fit together and internally snap into position which holds the lock together once assembled.

A further object of the invention is to increase the ease of construction of the padlock by reducing the number of component parts and the number and complexity of the assembly steps.

A further object of the invention is to reduce the need for significant tooling by providing an assembly that does not require any complex or costly machinery operations.

These and other objects of the present invention are realized by providing an easily assembled padlock with relatively few parts. These parts include a casing, and insert shell having a lock plug bore for insertion into the casing, a shackle, a lock bolt means actuated by a spring means, a key operated lock plug for engaging and moving the lock bolt means, a latching means for securing the lock plug in the insertable shell bore and a mutual engageable detent means for limiting movement of the lock plug within the shell bore. Assembly of the padlock is relatively easy as the components are designed to fit together and be held in place with only minimal further assembly operations. This padlock construction still has all the desirable features of a standard padlock, but because of the ease of production and assembly it has a significantly lower cost than other padlocks.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention, as determined by the appended claims.

DESCRIPTION OF THE PREFERRED EMBODIMENT

Figure 1:
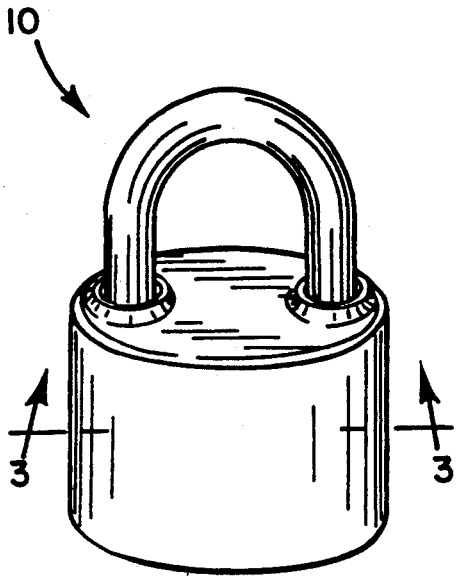
FIG. 1 is a perspective view of the padlock as assembled.

The padlock 10 of the present invention is depicted in FIG. 1. It can be seen that this padlock has the appearance of a padlock of the conventional type. The casing here is elliptical in shape, although the invention is not limited to that shape. The padlock 10 as shown in FIG. 1 also has the normal safety and locking features associated with a conventional padlock. Nonetheless, however, the padlock 10 represents significant cost reduction over conventional padlocks due to the relatively small number of components comprising the padlock 10, and the ease of assembly of those components. In its broad aspect, the padlock 10 of the present invention is comprised of components that are designed to fit together and be held in place without further complex or costly assembly steps. These components, to be discussed in detail below, include an outer casing having shackle-receiving holes in its top wall for receiving a generally u-shaped shackle, the shackle being of the conventional type with notches adjacent to each end. The padlock 10 further comprises an insert shell adapted to be placed within the outer casing, and to be attached thereto. This insert shell is adapted to receive and hold in place all the other components making up the padlock 10. To achieve this, the insert shell has a lock plug bore extending along its length, a pedestal means at the top of the lock plug bore, and a shackle receiving means on opposite sides of the lock plug bore for holding the shackle. The padlock 10 further comprises a key operated lock plug having tumblers for preventing rotation of the lock plug unless actuated by the key in the conventional manner. This lock plug further includes actuator end means for engagement with a lock bolt means. The lock plug is held in the lock plug bore of the insert shell by a latching means, and its rotational motion inside the lock plug bore, when actuated by the key, is limited by mutually engageable detent means. The padlock 10 also has a moveable lock bolt means that is receivable by the pedestal means, and is, as indicated above, engaged by the lock plug actuator end means. This engagement by the lock plug actuator end means of the lock bolt means allows the lock bolt means to be positioned selectively in one of three positions. These positions include an assembly position where the shackle can be inserted through the outer casing and into the shackle means of the insert shell. A second position for the lock bolt means is an unlocked position. In this position the lock is unlocked and the shackle is free to move up and down while still being retained within the lock itself. The third position is the locked position where the lock bolt means engages the shackle notches and locks the shackle into place. The padlock 10 further includes a spring means for engaging the lock bolt means and biasing that means to the locked position previously described. That is, when the lock bolt means is moved away from the locked position the spring means is adapted to move the lock bolt means back to the locked position. This spring means in cooperation with the other components mentioned, allows the padlock 10 to be easily assembled and held together without high cost or heavy tooling of the padlock 10.

Figure 2:
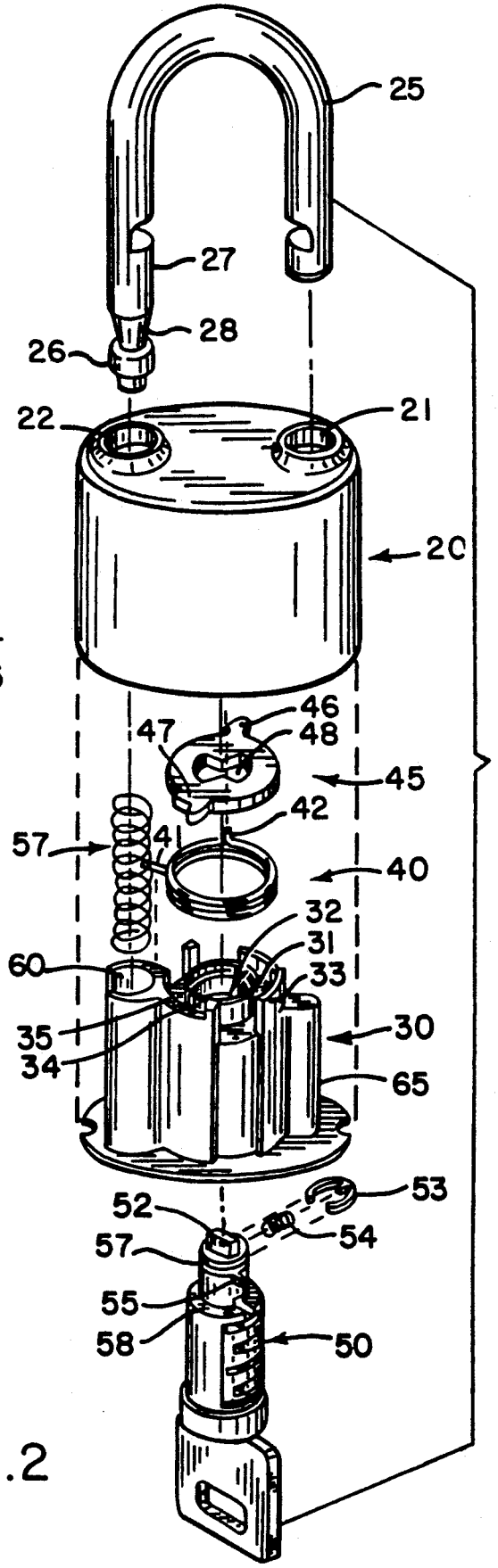
FIG. 2 is an exploded view of the padlock and its component parts.
Figure 3:
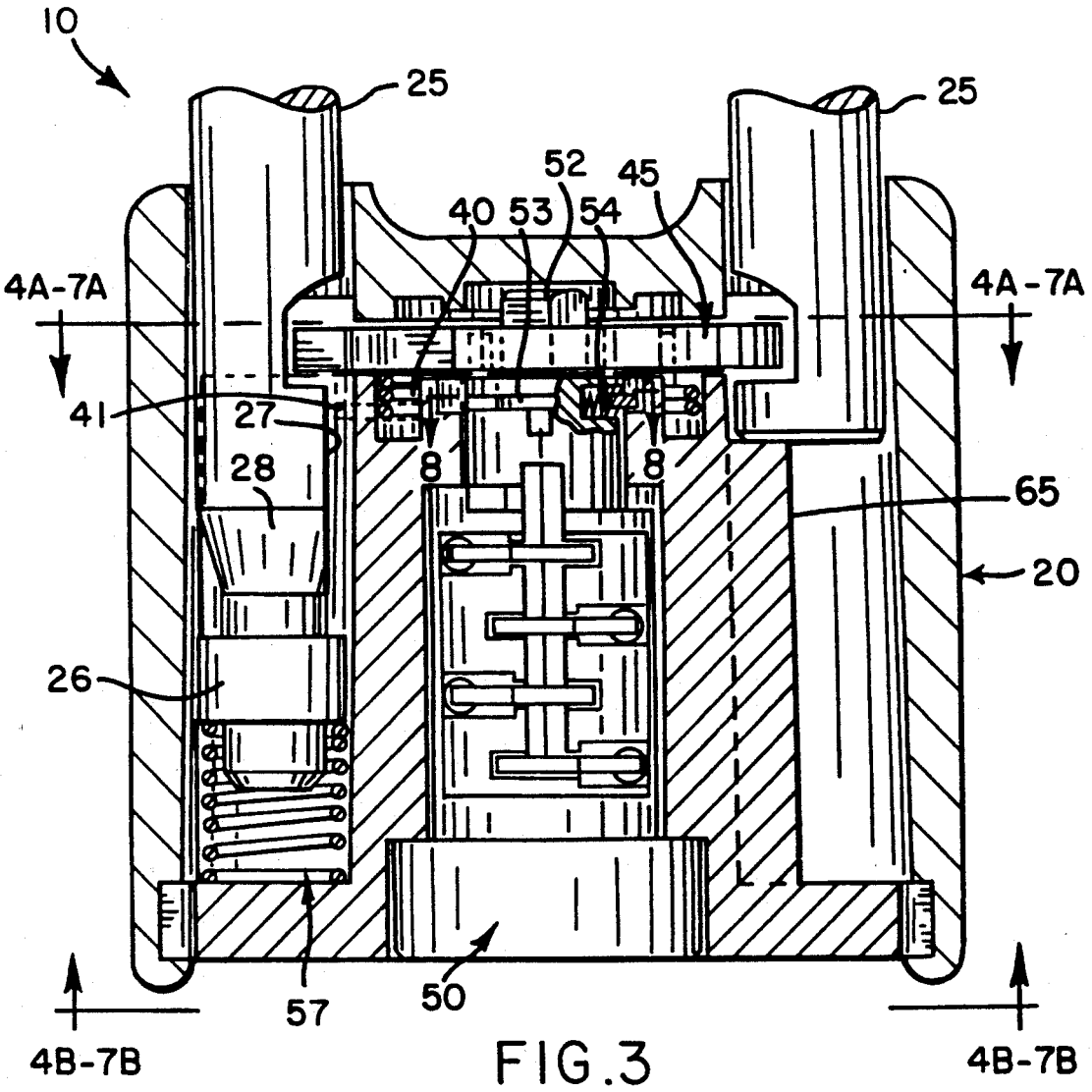
FIG. 3 is a side-sectional view of a padlock in the locked position.

The padlock 10 of the present invention described above will now be described in detail with reference to a specific embodiment. The components and means described above will now be exemplified by the parts of the padlock 10 illustrated in FIG. 2. FIG. 2 shows one embodiment of the padlock of the present invention in an exploded view. From that embodiment, it can be seen that the various components are designed to all fit within, and be held within the outer casing 20. The outer casing 20 has an open bottom for receiving the remaining components except the shackle 25 which is received in the casing 20 through the shackle-receiving openings 21,22. The insert shell 30 of this embodiment is designed to fit within the casing 20, and it is also designed to hold the various components of the padlock 10. The pedestal means 31 is for receiving both the spring means in the form of a torsion spring 40 and the lock bolt means in the form of a lock bolt 45, to be discussed below. The pedestal means 31 is located on top of the lock plug bore 32 which extends the length of the insert shell 30. The lock plug bore 32 is for receiving the key actuated lock plug 50. The tumbler portion of the lock plug 50 is of the conventional design. At the end of the lock plug is a tab 52 which serves as the actuator end means in this embodiment to engage the center cut out of the lock bolt 45 to position the lock bolt in its various positions. The snap ring 53 as actuated by the spring 54, is the latching means of this embodiment, and serves to hold the lock plug within the lock plug bore of the casing 30, when the padlock 10 is finally assembled. The detent 55 of the lock plug 50 engages another detent in the pedestal means 32 to limit the rotation of the lock plug within the lock plug bore where the lock is fully assembled. As can be seen from the drawing, the lock plug is adapted to be placed within the lock plug bore with the tab 52 extending beyond the pedestal means 31 to engage the lock bolt 45. The shackle 25 is also designed to fit within the inner casing 30. Shackle spring 57 and a long leg of the shackle 25 are designed to fit within the shackle housing 60, one of the shackle receiving means of the inner casing 30. The other shackle receiving means of the insert shell 30 is the shackle stop 65. When the padlock 10 is locked, the short leg of the shackle 25 rests on top of the shackle stop 65.

Each of the elements described above will now be described in greater detail, with particular attention paid to how these components fit together and cooperate to form the completed padlock 10 without great complexity, and at an inexpensive cost.

The casing 20 is preferably made by die casting. This avoids any need for drilling or other heavy tooling having to be done to the casing to form the shackle receiving holes 21, 22. The casing depicted in FIG. 2 is roughly elliptical in shape, however the invention is not limited to such a shape. In the present embodiment, the shackle-receiving holes 21, 22 are extended slightly above the surface at the top of the casing, and have a gradually sloping side wall down to the top surface of the casing. The bottom of the casing 20 is open for the purpose of receiving the insert shell 30, and all the components that are disposed within or on the insert shell 30. The opening in the bottom of the casing 20 has an inner rim for engaging the base of the insert shell 30 when it is inserted. Further, the side walls extend beyond this rim, and are adapted to be crimped around the base of the inner housing 30 as a final assembly step in completing the padlock 10. In the present embodiment, the casing 20 is preferably made of a corrosion-resistent material for protecting the inner components of the lock from the elements.

The insert shell 30 is also preferably formed by die casting. Again, this avoids the need for heavy tooling of the lock components in order to have bores, or other means for receiving the shackle and the lock plug. The many design features of the insert shell 30 give this padlock the unique characteristic of ease of assembly. The shackle housing 60 is adapted to receive the shackle spring 57 and the long leg of the shackle 25, when they are inserted through the shackle receiving hole 22 in the casing 20. The circumference of the partial cylindrical shell is adapted to be slightly larger than the circumference of the widest part of the shackle 25, so that only rotational movement and up and down movement within the shackle housing 60 of the shackle 25 is allowed. The shackle stop 65 is located directly opposite the shackle housing 60 on either side of the lock plug bore 32. The shackle stop is designed to serve as a resting place for the end of the short leg of the shackle 25 when the padlock is in the locked position. The shackle casing 60 and the shackle stop 65 thus combine to serve the function that is usually performed by separately drilled bores in a solid casing for conventional padlocks.

The pedestal 31 of the insert shell 30 is adapted to receive the torsion spring 40 that actuates the lock bolt 45. The pedestal 31 cooperates with pedestal sidewalls 33 to house the torsion spring. The torsion spring extension 41 engages sidewall 33 on one side of the shackle casing 60 to prevent the extension 41 from rotating further in a counter-clockwise direction according to the drawing FIG. 2. The other extension of the torsion spring 42, engages with one of the flanges 46 on the lock bolt 45 to be discussed below. The sidewalls 33 and the inner wall 34 form an annular chamber in which the torsion spring rests. The sidewalls 33 also perform another function. When the lock is fully assembled the sidewalls 33 prevent access through the shackle opening 21 to either the torsion spring 42 or, more importantly to the lock bolt 45. The inner wall 34 also has a collar 35 in its interior, which is located at the top of the lock plug bore 32. This collar 35 has a gap which engages with the detent 55 on the lock plug to restrict the rotation of the lock plug within the lock plug bore and forms the mutually engageable detent means referred to herein. This collar 35 also serves as an engagement for the snap ring 53 as actuated by the spring 54 for holding the lock bolt in place so that it cannot be withdrawn from the lock bolt bore 32.

The lock bolt 45 will now be discussed in detail. As can be seen from FIG. 2, the lock bolt 45 is roughly disk-shaped with a central opening 48 and two flanges 46 and 47. The central opening is adapted to receive the tab 52 of the lock plug and to be engaged with that tab so that the lock plug 50 can rotate the lock bolt 45 to various positions. The flange 46 engages the cut-out on the short leg of the shackle 25 when the lock bolt, and thus the padlock, are in the locked position. The flange 46 has a indentation for receiving the extension 42 of the torsion spring 40. The other flange 47 is adapted to engage the long leg of the shackle 25 in a variety of ways depending on the position of the lock bolt. In the locked position, the extension of the flange 47 is engaged with the cut-out on the long leg of the shackle, in a conventional manner. In the unlocked position, where the lock bolt has been rotated such that the flange 46 is no longer engaged with the cut-out on the short end of the shackle 25, the flat portion of the flange 47 is adjacent to the flat portion 27 of the long leg of the shackle 25. This allows up and down motion of the shackle within the shackle casing 60. Due to the geometry of the lock, this restricted up and down motion only occurs when the short leg of the shackle is still within the shackle receiving opening 21. When the short leg of the shackle 25 has cleared the opening 21, the flange 47 of the lock bolt is no longer adjacent to the flat portion of the long leg of the shackle 25, but rather is adjacent to the tapered region 28 of the long leg of the shackle 25. This allows the shackle 25 to be rotated within the shackle casing 60 so that the short end of the shackle 25 can clear the top of the casing 20 to allow the padlock to be removed from whatever it is holding locked. The shackle 25 is prevented from being removed from the lock by means of a flared cylinder 26 on the long leg of the shackle 25.

Figure 4A:
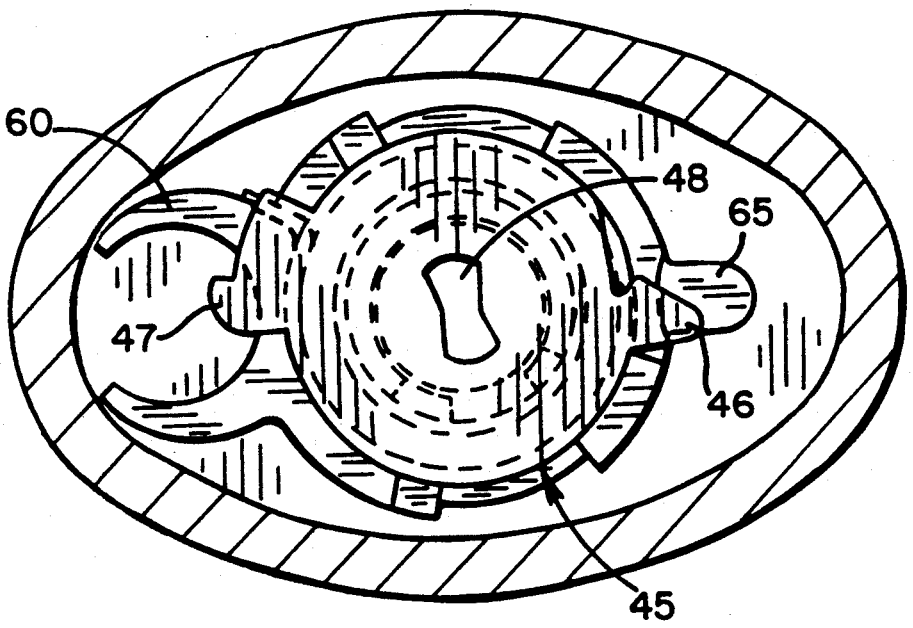
FIG. 4*a* is a sectional plan view of the inside and outside housing at a stage of lock assembly.
Figure 4B:
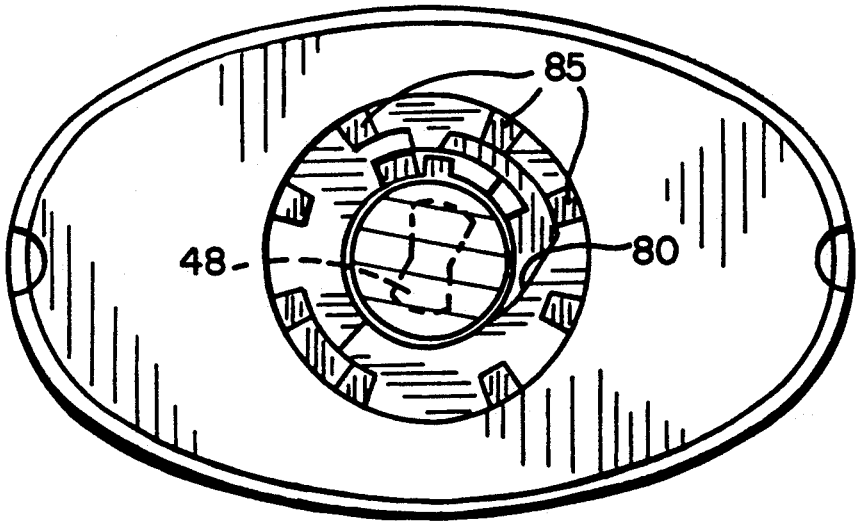
FIG. 4*b* is a bottom view of the padlock with a partial section view of the top portion of the insert housing and lock bolt during a stage of padlock assembly.
Figure 5A:
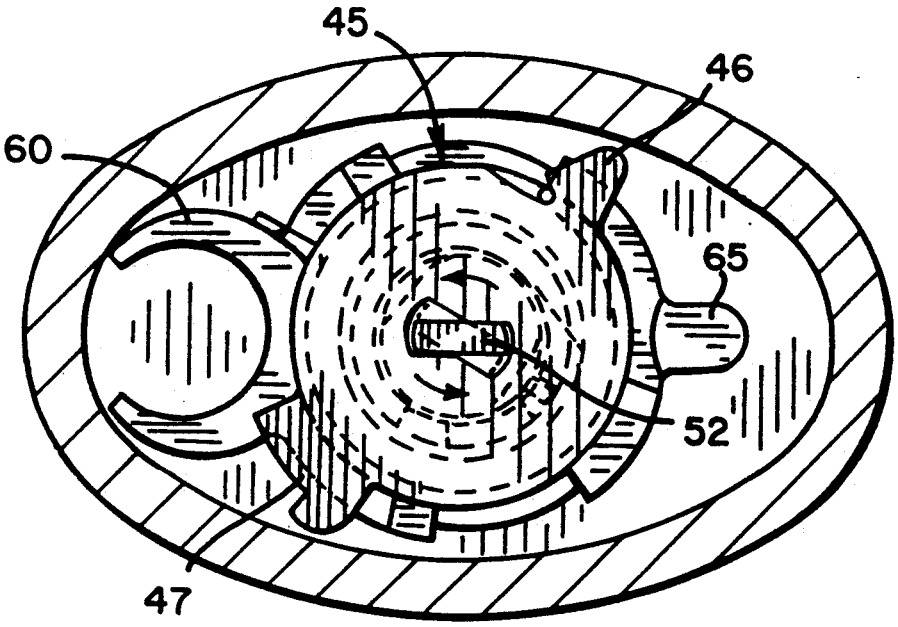
FIG. 5*a* is a sectional plan view of the inside and outside housing at a stage of lock assembly.
Figure 6A:
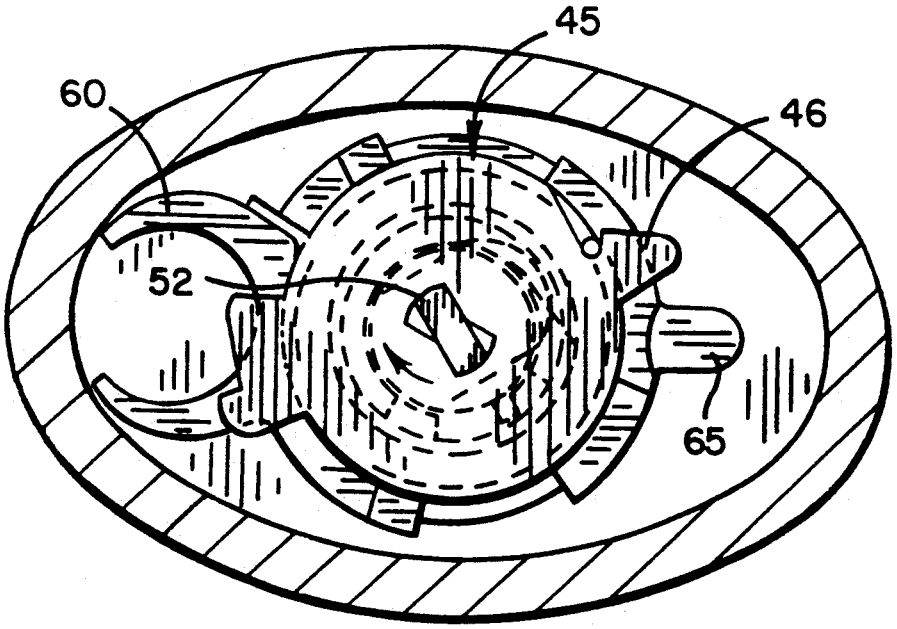
FIG. 6*a* is a sectional plan view of the inside and outside housing at a stage of lock assembly.

The lock bolt 47 is also rotatable into an assembly position. In the assembly position, the lock bolt is rotated such that the flange 47 is not covering the opening in the top of the shackle casing 60 of the insert housing. Thus, during assembly of the padlock, the insert housing 30 having the torsion spring 41 and the lock plug 45 in place is inserted into the bottom casing 20. As will be explained in greater detail below, the lock plug is then inserted and engages the lock bolt. Before the lock plug is used to rotate the lock bolt 45, the lock bolt 45 is in the locked position due to the action of the torsion spring 40. As can be seen from FIG. 4*a* this causes the flange 47 to cover the top of the shackle casing 60 such that the shackle cannot be inserted. The lock bolt is then rotated to the position seen in FIG. 5*a*. There, it can be seen that the rotation has caused the flange 47 to be moved to a position where the top of the shackle casing 60 is clear. Thus, the long leg of the shackle 25 can now be inserted through the shackle receiving opening of the casing 20 and into the shackle casing 60 on the insert housing. As will be discussed below, the lock bolt is now turned backed to the locked position and the lock plug is secured in place. FIG. 6*a* shows the lock bolt in the unlocked position. The flat portion of the flange 47 in this position is adjacent to the flat portion 27 of the long leg of the shackle 25, or adjacent to the tapered region 28 to allow free rotation of the shackle 25. It should be noted that since the lock bolt 45 is biased by the torsion spring 40, that when the shackle is pushed in such that the short leg enters the shackle receiving opening 21 of the casing 20 and continues downward, the padlock will snap closed when the opposing cut-outs of the shackle are even with the flanges 46, 47 of the lock bolt 45. At that point, the lock bolt 45 will be allowed to rotate into the locked position whereby it will be engaged the opposing cut-outs and lock the lock.

When the lock is unlocked, the lock bolt is rotated counterclockwise until the flanges 46, 47 of the lock bolt 45 are no longer engaging the opposed cut-outs in the shackle 25. At that point, the shackle spring 57 exerts an upward force on the shackle 25. Because of this motion, the lock bolt is now held in the unlocked position because its rotation back to the locked position is prevented by the presence of the shackle 25. It will only rotate back to the locked position as caused by the torsion spring 40, when the flanges 46, 47 are again adjacent to the opposed cut-outs, thus allowing the rotation.

Figure 8:
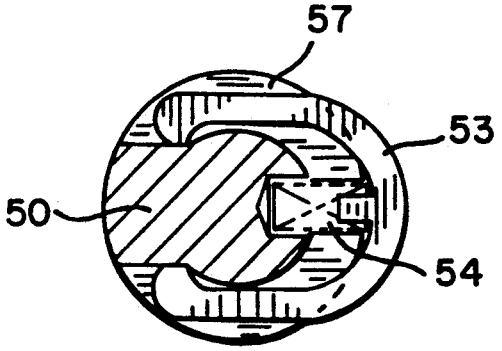

The lock plug 50 will now be explained in greater detail. The lock plug 50 has a conventional body comprising tumblers that are actuated by the proper key. On top of the body of the lock plug 50 is a detent 55 which, along with the gapped collar 35 of the pedestal means 32, forms the mutually engageable detent means referred to above. That is, the detent 55 is at the same level as the gap in the collar 35 when the lock is fully assembled. Thus when a key is inserted and the tumblers are moved out of position where they prevent the rotation of the lock plug 50, the detent 55 only allows the lock plug 50 to rotate a limited amount as determined by the size of the gap in the collar 35. At the end of the lock plug 50 is a tab 52 that engages the opening 48 in the lock bolt 45, thereby allowing the lock plug 50 to rotate the lock bolt 45 to its various positions. Located between the detent 55 and the tab 52 is a groove 57 which runs almost around the entire circumference of this portion of the lock plug 50. A cross section of this groove is shown in FIG. 8. The shaded portion of FIG. 8 represents the remaining material of the lock bolt, and the surrounding unshaded area is the circumferential groove. It can be seen from FIG. 9 that the purpose of the circumferential groove is allowing the snap ring 53 to be received therein. The snap ring 53 is roughly horseshoe shaped and is hooked at the end to engage the circular portion that remains of the lock bolt 50 after the circumferential groove 57 has been formed. The remaining stem of the lock bolt 50 also has an indentation for receiving the snap ring spring 54. Snap ring spring 54 is a compression spring such that when the snap ring 53 is moved to the left in FIG. 8, snap ring spring 54 will exert a restoring force on the snap ring 53 tending to push it back to the right. It is by virtue of this action that the snap ring 53 along with the snap ring spring 54 serves as the latching means of the present invention for securing the lock plug within the inner casing 30 of the padlock 10.

The various components described above are quickly and easily assembled into a completed padlock. Assembly begins by placing the torsion spring 40 on the pedestal means 31, and then placing the lock bolt 45 on top of that. The insert shell 30 is then inserted into outer casing 20. At this point, as noted above, the lock bolt 45 is in the locked position. According to FIG. 4*a*, the flange 47 is partially covering the opening to the shackle casing 60 thus preventing insertion of the shackle into the lock. The lock plug 50 is now inserted into the lock plug bore 32 from the bottom. The tab 52 engages with the opening 48 of the lock bolt 45 to allow the lock plug 50 to rotate the lock bolt 45. The snap ring 53 is in its extended position, thus preventing the complete advancement of the lock plug 50. That is, because the snap ring 53 is extended, its top surface will engage with the bottom surface of the collar 35. Once the tab 52 engages the opening 48 of the lock bolt 45, the lock plug 50 is rotated such that the lock bolt 45 moves to the position indicated in FIG. 5*a*. There, it can be seen that flange 47 has now moved so that it is totally clear of the top of the shackle casing 60. This allows insertion of the shackle spring 57 and the long leg of the shackle 25 through shackle receiving hole 22 and into the shackle casing 60.

Figure 5B:
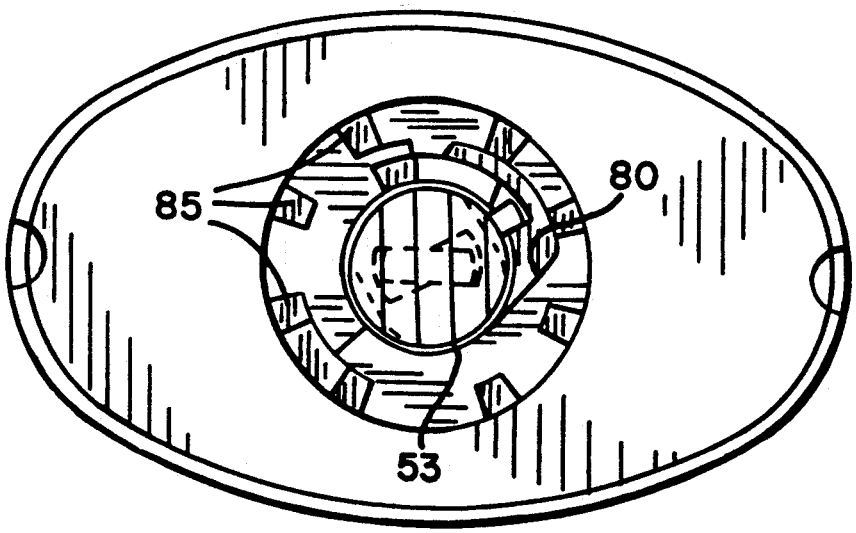
FIG. 5*b* is a bottom view of the padlock with a partial section view of the top portion of the insert housing and lock bolt during a stage of padlock assembly.
Figure 6B:
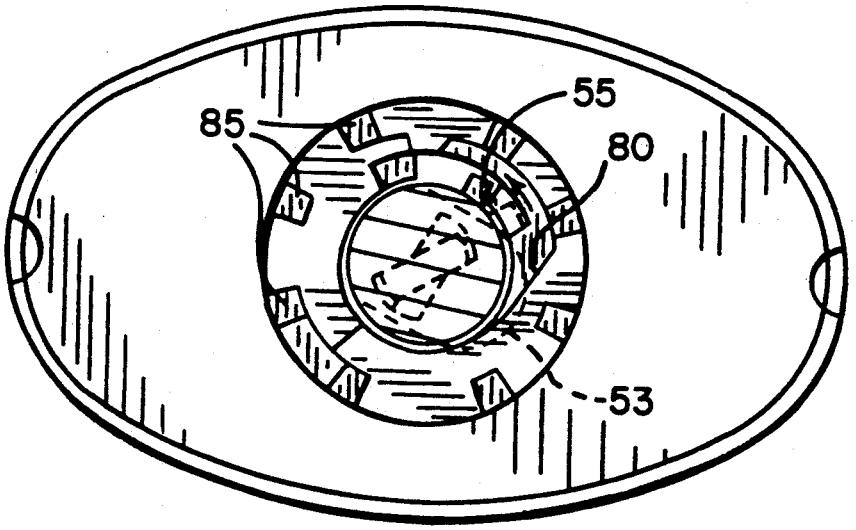
FIG. 6*b* is a bottom view of the padlock with a partial section view of the top portion of the insert housing and lock bolt during a stage of padlock assembly.
Figure 7A:
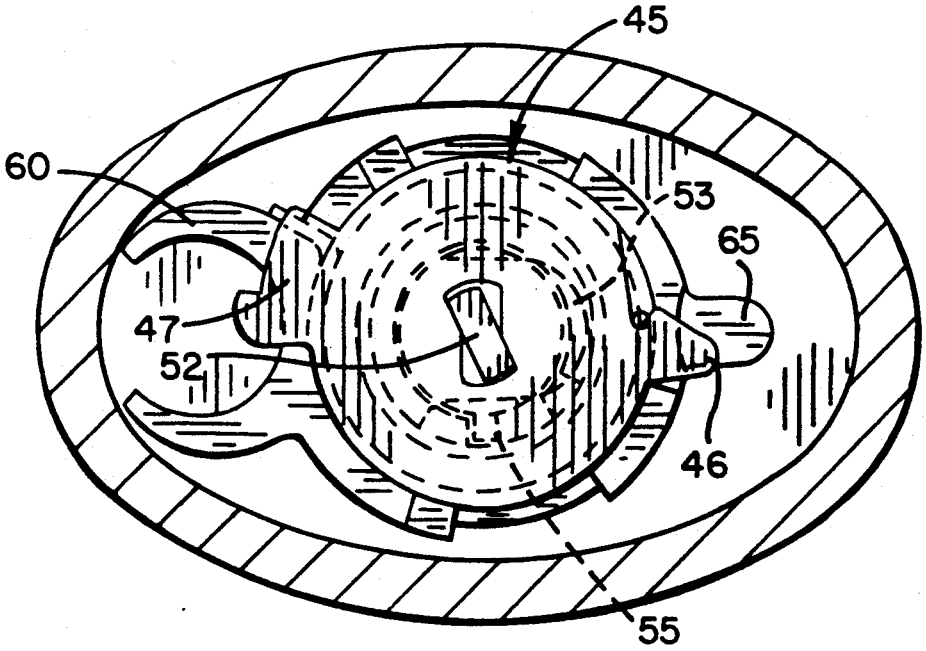
FIG. 7*a* is a sectional plan view of the inside and outside housing at a stage of lock assembly.
Figure 7B:
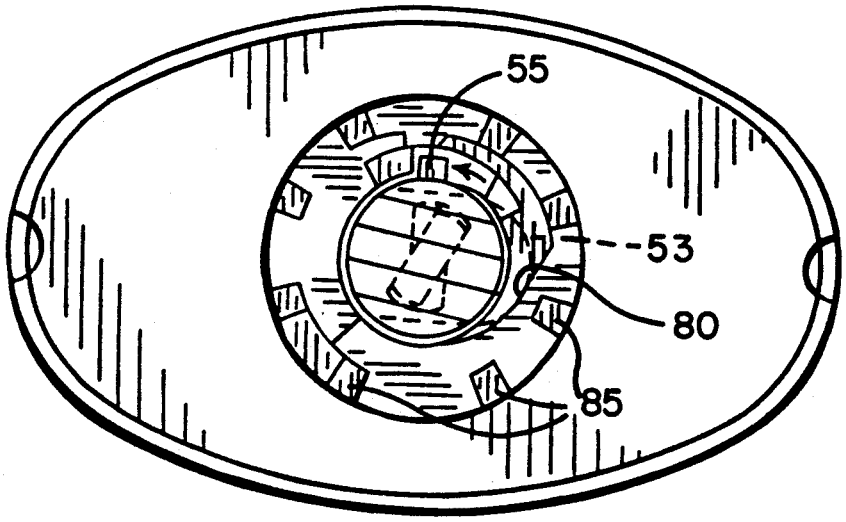
FIG. 7*b* is a bottom view of the padlock with a partial section view of the top portion of the insert housing and lock bolt during a stage of padlock assembly.

After the shackle 25 has been inserted, the lock plug 50 is rotated such that the lock bolt 45 is placed in the unlocked position, shown in FIG. 6*a*. It is this action of rotating the lock bolt from the assembly position to the unlocked position that actuates the latching means, as embodied by the snap ring 53 and snap ring spring 54 to secure the lock bolt in place within the insert shell 30. This action can best be seen by reference to FIGS. 5*b* and 6*b*. In FIG. 5*b*, the lock plug bore 32 is viewed from the bottom and has a partial section view of the top portion of the lock plug. The detent 55 and the snap ring 53 are shown. Also shown is a stop 80. The stop 80 is an extension of one of the ridges 85 that runs longitudinally along the inside of the lock plug bore 32. As the lock bolt 50 is rotated such that the lock bolt moves from the assembly position to the unlocked position, the snap ring 53 engages the stop 80. The stop 80 causes the snap ring to be pushed into the circumferential groove 57 until the snap ring is flushed with the lock bolt 50 as is best seen in FIG. 6*b*. Also during this rotation, the detent 50 has been rotated such that it is aligned with the gap in the collar 35. Once this has occurred, there is nothing impeding the progress of the lock bolt 50, and the lock bolt 50 advances until the shoulder 58 of the lock bolt 50 engages the bottom of the gapped collar 35. As the lock bolt 50 advances, and the snap ring 53 comes above the top of the gapped collar 35, it is no longer engaged with the stop 80. As a result, snap ring spring 54 pushes the snap ring back out to a position where the bottom of the snap ring is now engaged with the top of the gapped collar 35. That is, the snap ring 53 has now latched the lock plug 50 in place, and it cannot be withdrawn. In FIG. 7*b*, the snap ring 53 is shown again in its extended position, the position it is in once it is cleared the top of the gapped collar 35. As noted above, the detent 55 is now engaged in the gap of the gapped collar 35. This limits the rotation of the lock plug such that the lock bolt is only capable of rotation between the unlocked and locked positions. Thus, the shackle 25 is now permanently held within the insert shell 30 since the lock bolt 45 cannot be rotated such that the flange 47 would not be preventing the shackle from leaving the shackle casing 60.

Thus, by the few simple manipulative motions described above, the padlock has been assembled. To summarize briefly, the torsion spring 40 is placed on top of the insert shell 30, followed by the lock bolt means 45. The insert shell is then inserted into the bottom of the casing 20. The lock bolt 50 is inserted into the lock plug bore 32 until the tab 52 engages the opening 48 in the lock bolt. The lock bolt is then rotated into the assembly position allowing insertion of the shackle spring 57 and the long leg of the shackle 25. The lock bolt is then rotated to the unlocked position, thereby allowing the snap ring 53 to be pushed in allowing advancement of the lock plug 50. After passing the top of the gapped collar 35, the snap ring is pushed back out and secures the lock plug 50 in place within the insert casing 30. By engagement of the detent 55 with the gap in the gapped collar 35 the rotation of the lock bolt 45 is limited to rotation between the locked and unlocked positions. When the padlock has been assembled to this point, a final assembly step is required, where the end of the casing 20 is crimped around the base of the insert shell 30. The result is an inexpensive and easily assembled padlock.

What is claimed is:

1. A padlock comprising in combination:

an outer casing having a top wall, side wall and open bottom, and having a pair of spaced apart shackle-receiving openings in said top wall;

a generally U-shaped shackle having a first leg and a second leg, each including notches adjacent their ends and each adapted to be received by the shackle-receiving openings;

an insert shell adapted to be received by the outer casing and fixedly attached thereto and including pedestal means, the pedestal means having a lock plug bore extending therethrough and shackle receiving means disposed on opposite sides of the lock plug bore and wall means disposed between said lock plug bore and said shackle receiving means, said lock plug bore including longitudinally extending guiding ridges;

a key operated lock plug including actuator end means adapted to be inserted in the lock plug bore, guided into position by said guiding ridges, held therein by a latching means, and adapted to be limited in movement within the lock plug bore by the mutual engagement between a detent member extended from said lock plug and the gapped portion of gapped collar means disposed within said lock plug bore, said gapped collar means extending from the perimeter of the lock plug bore towards the center of the lock plug bore and comprising an upper surface, a lower surface and gap means connecting said upper and lower surfaces;

a movable lock bolt means, receivable by the pedestal means and engageable by the lock plug actuator end means for positioning the lock bolt means in a first "assembly" position, a second "unlocked" position for retained opening of the shackle, and a third "locked" position where the lock bolt means engages the shackle leg notches for locking the shackle, said "unlocked" position being intermediate said "assembly" and "locked" positions;

a spring means for engaging the lock bolt means and biasing the lock bolt means to the third "locked" position both before and after engagement between said lock bolt means and said lock plug actuator end means, such that when the lock plug is first inserted, the lock bolt means is positioned by the lock plug actuator end means in the first "assembly" position by rotation of said lock plug allowing insertion of the shackle into the outer casing, the lock bolt means is moved to the second "unlocked" position whereby the latching means is actuated and the mutually engageable detent means are engaged such that the lock bolt means is precluded from returning to the first "assembly" position thereby allowing only an opening and snap closing of the shackle with operation of the lock plug by a proper key.

2. A padlock as claimed in claim 1 wherein said lock plug latching means includes a spring biased snap ring means occupying an eccentric position with respect to the axis of the lock plug, said snap ring means rotatably engaging extended stop means during assembly of said padlock, thereby substantially eliminating the eccentric orientation between the lock plug and the snap ring means and permitting passage of said snap ring means through said gapped collar after which the eccentric orientation between the lock plug and the snap ring means is resumed and withdrawal of said lock plug is prevented by engagement between said snap ring means and said upper surface of said gapped collar means.

3. A padlock as claimed in claim 1 wherein said movable lock bolt means is disk-shaped and rotatably engaged by the lock plug actuator end means and said spring means is a torsion spring which normally holds said lock bolt means in the locked position both before and after assembly.

4. A padlock as claimed in claim 1 wherein said lock bolt means positioned in the second "unlocked" position is engageable with a shackle leg notch retaining the shackle against removal from the casing and allowing the shackle in its upwardly position to rotate about one of the openings in the casing top wall.

5. A padlock as claimed in claim 1 wherein said fixed attachment of said insert shell to said outer casing includes a crimping of the casing about the base of the insert shell.

6. A padlock comprising in combination:

an outer casing having a top wall, side wall and open bottom, and having a pair of spaced apart shackle-receiving openings in said top wall;

a generally U-shaped shackle having a first leg and a second leg, each including notches adjacent their ends and each adapted to be received by the shackle-receiving openings;

an insert shell adapted to be received by the outer casing and fixedly attached thereto and including pedestal means, the pedestal means having a lock plug bore extending therethrough and shackle receiving means disposed on opposite sides of the lock plug bore and raised wall means disposed between said lock plug bore and said shackle receiving means, said lock plug bore including longitudinally extending guiding ridges;

a key operated lock plug including actuator end means adapted to be inserted in the lock plug bore, guided into position by said guiding ridges, held therein by a latching means, and adapted to be rotationally limited in movement within the lock plug bore by the engagement between a detent member extended from said lock plug and the gapped portion of gapped collar means disposed within said lock plug bore, said gapped collar means extending from the perimeter of the lock plug bore towards the center of the lock plug bore and comprising an upper surface, a lower surface and gap means connecting said upper and lower surfaces said latching means comprising a spring biased member disposed about said lock plug adjacent said actuator end means;

a rotatably movable lock bolt means, receivable by the pedestal means and engageable by the lock plug actuator end means for angularly positioning the lock bolt means in a first "assembly" position, a second "unlocked" position for retained opening of the shackle, and a third "locked" position where the lock bolt means engages first and second shackle leg notches for locking the shackle, said "unlocked" position being intermediate said "assembly" and "locked" positions;

a torsion spring means for engaging the lock bolt means and normally biasing the lock bolt means to the third "locked" position both before and after engagement between said lock bolt means and said lock plug actuator end means, such that when the lock plug is first inserted, the lock bolt means is positioned in the first "assembly" position by rotation of said lock plug allowing insertion of the shackle into the outer casing, the lock bolt means is moved to the second "unlocked" position whereby the latching means is actuated and the mutually engageable detent means are engaged such that the lock bolt means is only movable between the second "unlocked" position and the third "locked" position thereby allowing only an opening or closing of the shackle with operation of the lock plug by a proper key.

7. A padlock as claimed in claim 6 wherein said shackle is snap closable without use of the key.

8. A padlock as claimed in claim 6 wherein said lock plug latching means is a spring biased snap ring whereby the snap ring is depressed upon insertion of the plug until bypassing the collar means and then the snap ring is released and retained against the upper surface of said collar fixedly holding the lock plug within the bore.

* * * * *